US006352089B1

(12) United States Patent
Breton

(10) Patent No.: US 6,352,089 B1
(45) Date of Patent: Mar. 5, 2002

(54) DISPENSING DEVICE, IN PARTICULAR FOR FILLING MACHINE FEEDER, AND FEEDER EQUIPPED WITH SAME

(75) Inventor: Thierry Le Breton, Pont-Aven (FR)

(73) Assignee: Hema Technologies S.A., Quimper (FR)

( * ) Notice: Subject to any disclaimer, the term of this patent is extended or adjusted under 35 U.S.C. 154(b) by 0 days.

(21) Appl. No.: 09/701,454

(22) PCT Filed: Jul. 16, 1999

(86) PCT No.: PCT/FR99/01744

§ 371 Date: Feb. 5, 2001

§ 102(e) Date: Feb. 5, 2001

(87) PCT Pub. No.: WO00/06453

PCT Pub. Date: Feb. 10, 2000

(30) Foreign Application Priority Data

Jul. 29, 1998 (FR) ..... 98 09900

(51) Int. Cl.[7] ..... B65B 1/04

(52) U.S. Cl. ..... 141/89; 141/90; 134/166 R

(58) Field of Search ..... 141/89, 90, 91, 141/92, 129, 135; 134/166 R, 169 R; 222/148

(56) References Cited

U.S. PATENT DOCUMENTS

| | | | | | |
|---|---|---|---|---|---|
| 4,915,147 | A | * | 4/1990 | Skibowski | 141/181 |
| 5,524,683 | A | * | 6/1996 | Mueller | 141/129 |
| 5,810,059 | A | * | 9/1998 | Rutter et al. | 141/92 |

FOREIGN PATENT DOCUMENTS

| | | |
|---|---|---|
| FR | 2625993 | 7/1989 |
| NL | 293087 | 7/1965 |

* cited by examiner

*Primary Examiner*—Steven O. Douglas
(74) *Attorney, Agent, or Firm*—Nilles & Nilles SC

(57) ABSTRACT

A device designed to be incorporated in a volumetric feeder having a body in which a distribution key with a vertical axis is rotatably mounted. The body with a truncated seat open at the base and at the top and having a lateral opening. The seat is designed to receive the dispensing key whereof the truncated part is open at the base and has a radial opening and is likewise open at the top in an axially extending stem projecting from the body towards the bottom and open in its distal end.

8 Claims, 3 Drawing Sheets

DISPENSING DEVICE, IN PARTICULAR FOR FILLING MACHINE FEEDER, AND FEEDER EQUIPPED WITH SAME

BACKGROUND OF THE INVENTION

The present invention concerns a distribution device able to be integrated in a volumetric measurer. It also concerns said measurer.

This distribution device is intended to alternately establish a communication channel between the storage tank and the cylinder of the volumetric measurer, and a communication channel between the cylinder and the outlet of the measurer. Said device is intended to be mounted at the end of the cylinder inside which a piston circulates.

As regards their current shape, distribution devices comprise a body in which a distribution key is mounted rotating, said key having an axial opening and radial internal passages via which it cooperates with the openings of the body so as to establish said communication channels.

In this conventional architecture, the outlet of the measurer at the end of a filling nozzle is inevitably offset by a distance from the communication opening of the body where the measurer carries out sealed closing between consecutive filling phases.

When pure liquids are being treated, this configuration does not bring about any problem as it merely suffices to equip the outlet of a joining piece with an adequate grille for preventing any ill-timed flow between the filling phases.

The situation is not the same with liquids loaded with particles or pieces since the use of a grille becomes impossible and there is no simple alternative. In practice, in this case it is impossible to avoid uncontrolled falls of the product which affect accuracy of the measuring and which also are sources of smears for boxes or packaging jars, as well as for the machine.

OBJECTS AND SUMMARY OF THE INVENTION

The invention is the result of a search to resolve this problem and consists of a new distribution device architecture for providing a simple and effective solution furthermore making it possible to install a cleaning system, also simple and effective compared to existing devices.

This distribution device of the invention includes a body in which a distribution key with a vertical axis is rotatably mounted. It is characterised in that said body comprises a truncated seat open at its base and top and having a side opening. The seat is intended to receive the distribution key, whose truncated portion is open at its base and has a radial opening, and is also open at its top in an axial extension tail coming out of the body towards the bottom and open at its distal extremity.

When this distribution device is installed in a measurer, the axial extension tail of the distribution key shall be arranged so as to constitute the opening towards the outlet of the measurer which could thus be located at the extremity of a joining piece or nozzle placed in line with said extension tail, that is centred on the rotation axis of the distribution key so as to allow to mount at the proper location of the outlet a shutter whose operational movements shall be linked to those of the distribution key.

Secondly, a simple translation movement of the distribution key in the body shall make it possible to sufficiently move away from each other all of the internal surfaces functionally in contact of the various elements of the distribution key, especially the distribution key and the faucet, so as to organise effective washing flows.

BRIEF DESCRIPTION OF THE DRAWINGS

The characteristics and advantages of the invention mentioned above and others shall appear more clearly on a reading of the following description with reference to the accompanying drawings on which.

DESCRIPTION OF THE PREFERRED EMBODIMENTS

Figure 1:
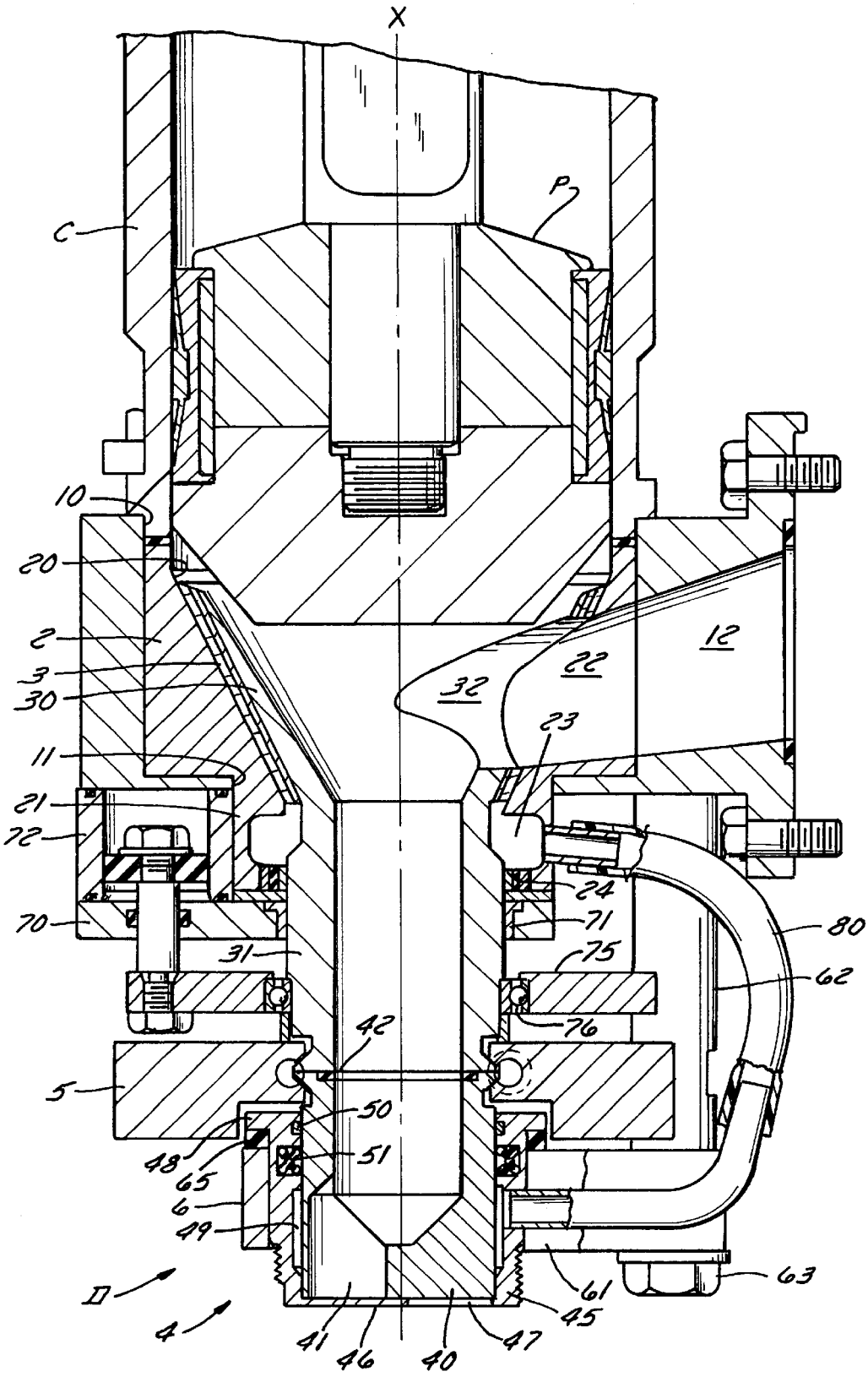
FIG. 1 is a diagrammatic view of an axial section of a distribution device according to the invention and mounted at the base of a measurer and at a position enabling the measurer to be loaded.

On the drawings, the invention is thus illustrated as applied to filling machine measurers and has been specially designed as much for said measurers.

This measurer basically includes a cylinder C, partially represented, a suction and force piston P in the cylinder C, and, mounted at the base of the latter, a distribution device D according to the invention which communicates with the cylinder C, and selectively with a storage tank of the filling machine (not shown) and with the outlet of the measurer.

The distribution device D comprises a body or faucet 1 having an approximately annular shape internally forming a cylindrical cup 10 whose bottom has a circular opening 11 centred on the axis X-X of the measurer. On one side the body 1 comprises fixing means to be connected in sealed communication with said storage tank by a communication channel 12 in its side wall.

Internally inside said cup, the body 1 closely receives an element 2 forming a seat having a cylindrical neck 21 traversing the bottom opening 11 of the body 1. The seat 2 internally has the shape of a truncated cone open upward by its base in the cylinder C and downward by its top in the neck 21 which close to its outlet has an annular chamber 23. The seat 2 secondly comprises a side opening 22 in its truncated wall portion which towards the inside extends the side opening 12 of the body 1.

The seat 2 cooperates with a distribution key 3 having the general shape of a horn whose truncated portion 30 is applied sealed against the internal truncated surface of the seat 2 and whose extension tail 31 comes outwardly through the neck 21 by traversing a gasket 24 mounted at the outlet of the latter.

The distribution key 3 is open upward by the base of its truncated portion 30 in the cylinder C and externally towards the bottom by the extremity of its tail 31, and it laterally comprises an opening 32 which, for a specific rotation position around X-X, comes into the extension of the openings 12 and 22 respectively in the seat 2 and the body 1.

According to one characteristic of the invention, the distribution device D further comprises a joining piece 4 by which the transfer of products between the measurer and the packagings to be filled is effected to be subsequently denoted as the outlet joining piece or filling joining piece. The joining piece 4 includes an internal cylindrical part or internal joining piece 40 connected sealed to the tail 31 of the distribution key 3 and whose other extremity is engaged with rotation aptitude around X-X in an external cylindrical part or external joining piece 45. The internal joining piece 40 is therefore centred on the axis X-X and has an outlet 41 offset and narrowed with respect to its inlet which is axial to it, so as to be fully outside the axis X-X, whereas the external joining piece 45, which is locked in rotation around X-X, comprises a bottom wall 46 with an opening 47, also offset centre in the same way as the orifice 41, that is so as to be fully outside X-X. With the extremity surface of the internal joining piece 40 surrounding the orifice 41 and the internal surface of the extremity wall 46 of the external joining piece 45 surrounding the opening 47 being applied in sealed contact with one on the other during operation, the joining piece is only open when the orifice 41 and the opening 47 are in correspondence and secondly the joining piece 4 is controlled on opening and closing via the drive in rotation around X-X of the unit constituted by the key 3 and the internal joining piece 40 which are integral with each other. The circumference of the orifice 41 in the joining piece 40 is preferably a sharp edge (at 90°), whereas the circumference of the opening 47 in the joining piece 45 is cut into a bevel flared towards the outside so as to obtain a perfect sectioning during closing.

The internal joining piece 40 is fixed at the end of the tail 31 of the distribution key 3 by means of a part 5 which, according to the invention, is used here to furthermore control the operational movements of rotation of the unit around X-X by conventionally cooperating by a disposition of cams formed at its periphery with fingers placed at specific locations on the path of the measurers in the filling machine.

The piece 5 is therefore a clamping collar, in other words an open ring provided with clamping means. In the embodiment shown, it internally comprises an annular throat with a V profile intended to receive opposite it the extremity shoulders of complementary profiles of the tail 31 and the joining piece 40 so that the clamping of the piece 5 has the double effect of producing an axial force applied between the two extremities in contact with each other of the key 3 and the joining piece 40 ensuring imperviousness between them with the aid of the gasket 42 mounted in the extremity of the joining piece and rendering integral the unit it forms with the key 3 and the joining piece 40 included in rotation around X-X.

The external joining piece 45 shall firstly also be locked in rotation and secondly its bottom wall shall be applied with a certain force against the corresponding extremity surface of the internal joining piece 40 so that their blocking function is effective. To this effect, the external joining piece 45 is borne in a ring 6 fixed overhanging under the body 1 and provided to this effect with a radial external arm 61 which is fixed at the end of small columns 62 mounted under the body 1 with the aid of screws 63. The joining piece 45 is engaged in the collar 6 and is in support on the upper edge of the latter by an upper small collar 48 with an elastomer washer 65 therebetween. It is the washer 65 which provides the application force between the extremities in contact with each other of the joining pieces 40 and 45, said force accordingly being adjustable with the aid of screws 63 ensuring the linking of the collar 6 with the small columns 62.

Moreover, the joining piece 45 internally has two extremity bores calibrated to the outer diameter of the internal joining piece 41 so as to receive it closely with, between the two, a recess 49 to be referred to subsequently. Inserted into the upper bore are a slide ring 50 and then below a gasket 51.

During operation, in the position of FIG. 1, the unit formed by the key 3 and the joining piece 40 is in a rotational position around X-X in which the obturator 4 is closed and the side opening 32 of the key 3 is open on the storage tank, that is in correspondence with the openings 22 and 12 in the seat 2 and the body 1. At the same time, the piston P in the cylinder C is in the bottom position. When the piston moves up, the cylinder C of the measurer shall be loaded with the product.

Figure 2:
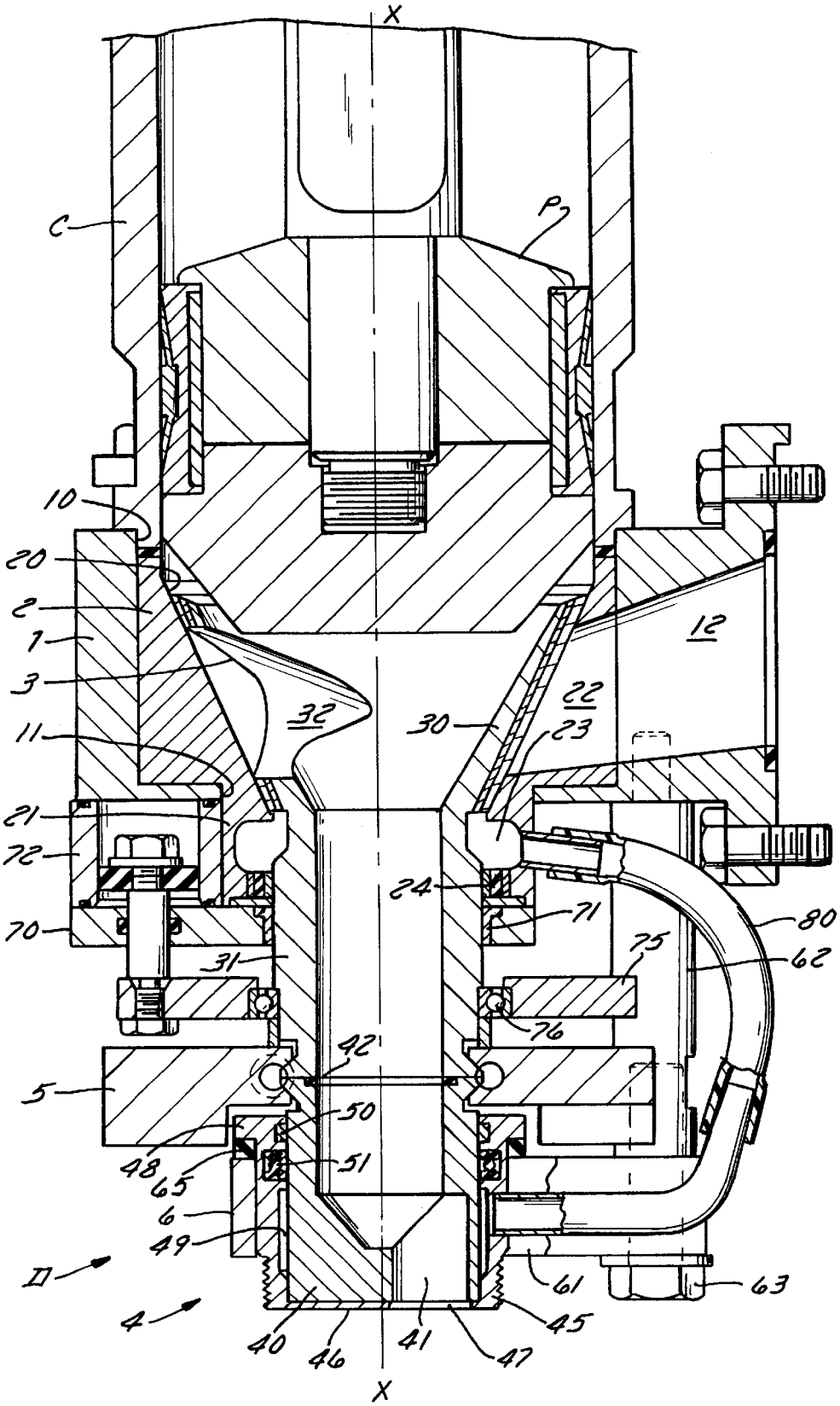
FIG. 2 is a view similar to FIG. 1 and represents the distribution device in a position enabling the measurer to carry out a filling operation.

Following this loading phase, the unit formed by the key 3 and the joining piece 40 shall be moved in rotation by the piece 5 so as to take up the position shown on FIG. 2: the obturator 4 is open, whereas the key 3 interrupts communication with the storage tank by sealing off the opening 22 in the seat 2. Under the effect of the moving down of the piston P inside the cylinder C, the charged product in the measurer is removed via the open filling joining piece 4.

Filling ends when the piston P again reaches its bottom position shown on the drawing on FIG. 2. It is to be noted that the extremity of the piston P is truncated and designed in such as way so as to penetrate into the key 3 as far as the upper level of the side opening 32 of the latter and that moreover the openings 32, 22 and 12 are cut so that the upper portion of their wall is continually rising towards the storage tank, this disposition constituting a simple element for automatically purging the air in the measurer.

Another significant advantage of the invention as a development of the latter is being able to associate with the distribution device an automatic cleaning system, that is a system able to provide an internal effective cleaning of all its components without the latter being dismantled.

This system shown on the drawings includes a means to move in translation along X-X the unit formed by the key 3 and the internal joining piece 40 with a view for cleaning to move away from each other the surfaces normally in operational contact inside the body 1 and the joining piece 4, circuit elements being advantageously associated with said means so as to optimise a cleaning flow inside the body 1 and the joining piece 4, as well as inside the cylinder C, that is in the whole unit of the measurer.

More specifically, in the embodiment shown, the means for moving in translation the unit formed by the key 3 and the internal joining piece 40 includes at least one pneumatic thrustor 72 placed on the side of the tail 31 between the lower part of the body 1 and a support 70 fixed under the lower extremity of the seat 2. In its passage opening for the tail 31, the support 70 advantageously comprises a guiding and sliding ring 71 below the gasket 24.

By means of its rod, the thrustor 72 moves in translation along X-X a collar 75 in which, by means of a roller 76, the tail 31 of the distribution key 3 is fixed so as to be solely able to freely rotate around X-X. It is to be noted that the thrustor 72 is advantageously arranged in such a way that in the operational position of the key 3 in the seat 2, it is not at the end of travel so that it is possible to allocate to it for an additional function for producing the required application force between the key 3 and the seat 2.

The circuit elements constitute a communication channel formed of a pipe 80 between the annular throat 23 in the neck 21 of the seat 2 and the recess 49 in the external joining piece 45. It is to be noted that in the embodiment shown, the pipe 80 includes a semi-rigid tube section passing inside the arm 61 of the collar 6, said arm 61 being to this effect formed of two symmetrical portions with respect to its longitudinal axis, this disposition being an extremely simple and effective means for locking in rotation the external joining piece 45 in its support ring 6.

Figure 3:
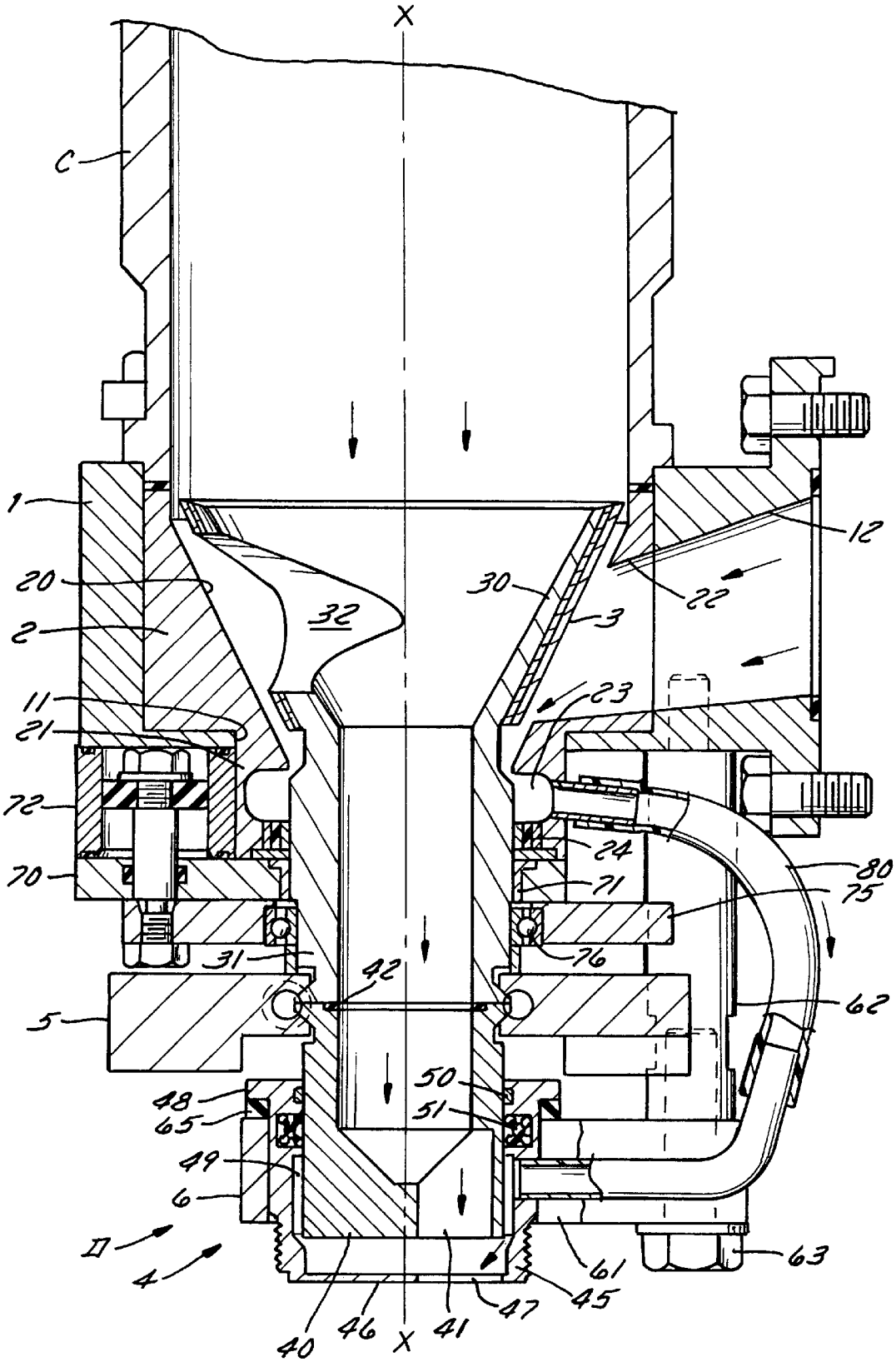
FIG. 3 is a view similar to the first two and represents the distribution device in a cleaning position.

FIG. 3 shows the measurer with the unit formed by the key 3 and the internal joining piece 40 in a cleaning position: the key 3 (in the position of rotation around X-X of FIG. 2) is spaced from the seat 2 so as to form with the latter a gap open upward in the cylinder C and downward in the throat 23. In the joining piece 4, the lower extremity of the internal joining piece 41 is lifted into the recess 49. A flow of cleaning liquid arriving from the storage tank via the openings 12 and 22 in the gap between the seat 2 and the key 3 is divided into two: towards the cylinder C and towards the annular throat 23. From the cylinder C, it goes down into the key 3, the internal joining piece 40 and into the recess 49 where it rejoins the other portion of the flow coming from the annular throat 23. The arrows show that all the internal surfaces of the measurer are effectively scavenged by the cleaning liquid. It is to be noted that it is possible to connect a conduit at the outlet of the joining piece 4, for example so as to organise a closed circuit for the cleaning liquid. Further, it is to be noted that it is also possible to then alternate the direction of the cleaning flow.

Apart from said advantages and those implicitly inherent in the above description, it is proper to note that the invention offers the possibility of having a complete range of versions of a given measurer which only vary concerning their filling joining piece 4 able moreover to be easily interchanged depending on the application: packaging of pure liquid, packaging of products with pieces, filling via the bottom, etc.

What is claimed is:

1. Distribution device for selectively establishing one fluid passage channel from several fluid passage channels and intended in particular for a filling machine measurer including a body or faucet (1) in which a distribution key (3) with a vertical axis (X-X) is rotatably mounted, said body comprising a truncated seat (2) open at its base and top and having a side opening (22), for receiving the distribution key (3) whose truncated portion is open at its base and has a side opening (32) and is also open at its top in a axial extension tail (31) coming downwards out of the faucet (1) and open at its distal extremity, said side openings (22, 32) being fluid passage openings extending one another for a specific rotation position of said distribution key (3) around (X-X), characterised in that an outlet joining piece (4) with a sealing function is mounted on alignment at the end of the extension tail (31) whose operational movements are linked to those of the distribution tail (3), said outlet joining piece (4) with a sealing function being controlled on opening and closing via the rotation of an internal joining piece (40) in a fixed external joining piece (45), said internal joining piece (40) being connected to the extremity of the tail (31) of the distribution key (3) so that it is integral in rotation with the latter, the external joining piece (45) internally having a recess (49) between two upper and lower bores calibrated to the outer diameter of the internal joining piece (40), and means being provided to move in translation along (X-X) the unit formed by the distribution key (3) and the internal joining piece (40) between their functional position and a cleaning position in which the distribution key (3) is slightly spaced from the seat (2),whereas the extremity of the internal joining piece (40) is lifted into the recess (49) of the external joining piece (45).

2. Device according to claim 1, characterised in that the extension tail (31) of the distribution key (3) and the internal joining piece (40) are connected by means of a ring (5) used to drive into rotation around the axis (X-X) the unit formed by the distribution key (3) and the internal joining piece (40) between their various functional positions.

3. Device according to claim 1, characterised in that inside the outlet joining piece (4), the internal joining piece (40) has an outlet (41) offset sideways so as to be fully outside the rotation axis (X-X), and the external joining piece (45) has a bottom (46) with an opening (47) similarly offset sideways so as to be fully outside the spin axis (X-X), the extremity surface of the internal joining piece (40) being functionally applied sealed against the bottom (46) of the external joining piece (46), the joining piece (4) being open when the outlet (41) and the opening (47) are in correspondence.

4. Device according to claim 1, characterised in that said means for moving in translation the unit formed by the distribution key (3) and the internal joining piece (40) comprise at least one pneumatic jack (72) mounted under the body (1).

5. Device according to claim 4, characterised in that said means to move in translation the unit formed by the distribution key (3) and the internal joining piece (41) including at least one pneumatic jack (72), have furthermore the function of producing the application force against the seat (2) of the distribution key (3) in a functional position.

6. Device according to claim 1, characterised in that the side opening (22) in the seat (2) extends towards the inside a side opening for the passage of fluid (12) in the body (1), and the top portion of the walls of the side openings (12, 22, 32), respectively of the body (1), the seat (2) and the distribution key (3) rises from the side opening (32) towards the side opening (12).

7. Measurer for a filling machine comprising a device according to claim 1 and end-mounted under a cylinder (C) provided with a suction-force piston (P) so that the seat (2) is open via the base of its truncated portion in the cylinder (C), the side opening (12) being intended to be connected to a storage tank.

8. Measurer according to claim 7, characterised in that the piston (P) in the cylinder (C) has a truncated head for penetrating the distribution key (3) when it moves downwards until reaching the opening of the side opening (32).

* * * * *